US007455005B2

(12) United States Patent
Giessler

(10) Patent No.: US 7,455,005 B2
(45) Date of Patent: Nov. 25, 2008

(54) ADJUSTABLE SLICING DEVICE

(75) Inventor: Richard L. Giessler, Chippewa Falls, WI (US)

(73) Assignee: National Presto Industries, Inc., Eau Claire, WI (US)

( * ) Notice: Subject to any disclaimer, the term of this patent is extended or adjusted under 35 U.S.C. 154(b) by 0 days.

(21) Appl. No.: 11/152,652

(22) Filed: Jun. 14, 2005

(65) Prior Publication Data

US 2005/0274244 A1 Dec. 15, 2005

Related U.S. Application Data

(60) Provisional application No. 60/579,299, filed on Jun. 14, 2004.

(51) Int. Cl.
*B26B 1/04* (2006.01)

(52) U.S. Cl. ..... 83/605; 83/608; 83/932; 30/123

(58) Field of Classification Search ..... 83/13, 83/699.51, 699.61, 605, 606, 642, 607, 608, 83/609, 932, 601, 651; 30/296.1, 114, 123
See application file for complete search history.

(56) References Cited

U.S. PATENT DOCUMENTS 681,068 A * 8/1901 Noack ..... 83/468.1
717,223 A * 12/1902 Leachman ..... 83/468.1
911,900 A * 2/1909 Newman ..... 83/608
1,746,744 A * 2/1930 Siegle ..... 83/34
1,830,284 A * 11/1931 Massa ..... 83/608
2,707,504 A * 5/1955 Hill ..... 83/564
3,780,436 A * 12/1973 Pellman ..... 83/607
4,054,994 A * 10/1977 Grossman ..... 30/296.1
4,187,865 A * 2/1980 Burton ..... 131/250
4,383,365 A * 5/1983 Metzigian ..... 30/114
4,624,166 A * 11/1986 Kreth et al. ..... 83/699.51
4,625,607 A * 12/1986 Maillez ..... 83/466.1
4,648,300 A * 3/1987 Hassenfelt, Jr. ..... 83/762
4,811,642 A * 3/1989 Sorbie ..... 83/608
5,873,294 A * 2/1999 Sciuto ..... 83/588
6,044,741 A * 4/2000 Sapp et al. ..... 83/468.7
6,311,598 B1 * 11/2001 Osborne ..... 83/745

* cited by examiner

*Primary Examiner*—Stephen Choi
(74) *Attorney, Agent, or Firm*—Patterson, Thuente, Skaar & Christensen, P.A.

(57) ABSTRACT

A slicing device includes a base for supporting a foodstuff to be sliced and a repositionable knife or blade having a pair of bosses disposed at one end of the blade that extends outwardly away from the blade. The pair of bosses of the blade is coupled to a blade holding rack that acts as a pivot or fulcrum for the blade. The pivot or lever action of the blade permits a user to easily cut through large or hard foodstuff. In one embodiment, the blade is adjustable in the rack to permit a user to lower the blade to make successively deeper slices into and eventually through the foodstuff.

12 Claims, 15 Drawing Sheets

ADJUSTABLE SLICING DEVICE

REFERENCE TO RELATED APPLICATION

The present application claims priority to U.S. Provisional Application No. 60/579,299, entitled "ADJUSTABLE SLICING DEVICE" filed Jun. 14, 2004. The disclosure of the aforementioned provisional application is hereby incorporated by reference to the extent not inconsistent with the present disclosure.

FIELD OF THE INVENTION

The invention relates to slicing devices for slicing foodstuff. More particularly, the invention relates to adjustable slicing devices for slicing foodstuff of different sizes and varying degrees of hardness.

BACKGROUND OF THE INVENTION

Slicing devices are known in the prior art and are typically used for cutting and slicing foodstuff such as meat, cheese, bread, fruits and vegetables. Typically, such devices generally comprise a frame coupled to a blade in one of several well-known configurations. In one example of a typical slicing device, the blade is fixed to the frame. The foodstuff is sliced by moving the foodstuff over or under an exposed element of the blade.

Users may encounter difficulty when there is a small amount of foodstuff between their hand and the blade. It is not uncommon for a person to injure himself or herself while trying to cut small pieces of foodstuff with this type of device.

U.S. Pat. No. 4,624,166 discloses a kitchen or domestic food slicer having a flat bed surface over which the food is moved and a knife mounted essentially across that surface. The knife alone being pivotably mounted such that its sharp leading edge can be raised or lowered relative the bed surface to vary the thickness of cut. The pivoting of the knife is achieved by cam surfaces on a pair of bars one positioned either side of the bed surface, the bars being slidable lengthwise by a rotatable knob and the cam surfaces including inclined portions to cause pivoting of the knife as the bars slide longitudinally.

The prior art also discloses a slicing device where the knife is pivotably mounted to the frame. U.S. Pat. No. 4,054,994, for example, provides a fixture for attaching the knife to an existing breadboard. The front end of the knife is pivoted to the attachment so that the knife may be pivotably swung for chopping foodstuff. In another arrangement the knife is provided with a longitudinally extending slot at the forward end so that the knife may be guided and moved longitudinally for slicing food and the like.

The prior art also discloses a knife-like device with parallel blades for chopping food. The blades may be pivotably attached to the frame and coupled together to move in parallel to each other. As will be evident to one of skill in the art, the inability to move the pivot axis with respect to the frame will constrain the knife edge to move along a fixed slicing path and will likely limit the size of foodstuff that can be sliced using such an arrangement.

In another example of a typical slicing device, the blade is slidably mounted on the frame. In this slicing device the foodstuff is placed on the frame in a generally fixed position. The foodstuff is cut by manually or automatedly moving or sliding the blade passed the foodstuff. As the foodstuff is cut, it is moved by hand or automatedly toward the moving blade so that the slicing process may continue until the foodstuff is completely sliced. The disadvantage of these types of slicing devices is that they are typically large and require a convenient source of energy.

In yet another typical slicing device the blade is pivotally coupled to the frame or base. A handle is coupled to a free end of the blade to permit a hand of a user to manually operate the blade. The foodstuff is cut by positioning the foodstuff on the base below the blade. A user slices the foodstuff by moving the blade downward toward the base. This slicing device typically includes a plurality of blades that permit a user to make multiple slices at a single time. However, the blade is generally fixed in a single location.

With the blade fixed in a single location, the size of the foodstuff that can be sliced is limited to the amount of space between the blade and the base. It is also difficult to slice the foodstuff when the blade is disposed generally perpendicular to the base. With the blade in this particular position it begins to slice the foodstuff at a generally ninety-degree angle to the base. At this angle the foodstuff has a tendency to move away from the blade.

In U.S. Pat. No. 717,223, the adjustable slicing device attempts to solve the problem of the positioning of the blade when it makes its initial slice by slidably coupling the blade or blades to a post mounted perpendicular to the base. This slicing device has the drawbacks of the size of the foodstuff that can be sliced and the slicing device cannot be effectively used to slice hard foodstuffs such as squash.

SUMMARY OF THE INVENTION

In one embodiment of the invention, a repositionable blade is provided for slicing various foodstuffs with a base having an upper surface for receiving the foodstuff. The blade has a pair of bosses extending therefrom proximate an end of the blade. The pair of bosses of the blade is preferably coupled to a rack that acts as a pivot or fulcrum for the blade. The pivot or lever action of the blade permits a user to more easily cut through tough or hard foodstuff. In one example embodiment, the blade is adjustable in the rack to permit a user to lower the blade to make successively deeper slices into and eventually through the foodstuff. The slicing device may also be disassembled for cleaning and sanitizing.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
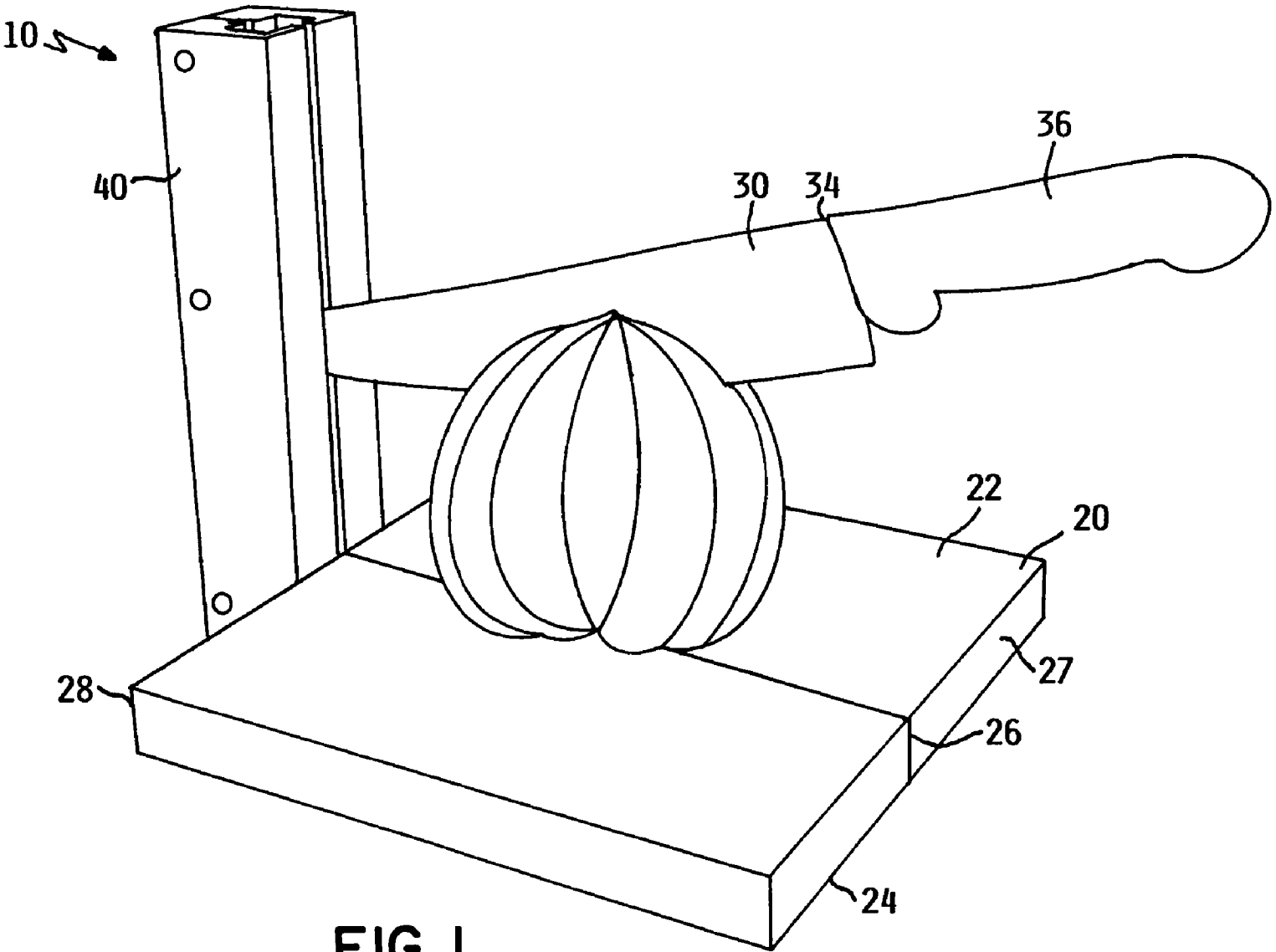
FIG. 1 is a perspective view of the adjustable slicing device.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents and alternatives falling within the spirit and scope of the invention as defined by the appended claims.

DETAILED DESCRIPTION OF THE DRAWINGS

The invention is directed to a slicing device having a blade for cutting foodstuff, and is particularly suited for slicing foodstuff such as vegetables that are large and that have a generally hard consistency. Referring to an example embodiment, illustrated in FIGS. 1-9, a slicing device 10 includes a base 20 for receiving foodstuff to be sliced and a blade holding or positioning rack 40 pivotally coupled to base 20. A blade 30 is preferably adjustably disposed to rack 40 to create a pivot point or fulcrum from which blade 30 can pivot.

Referring to FIG. 1, in this particular example embodiment of the invention, base 20 includes a substantially planar first surface 22 for receiving foodstuff and a generally planar second surface 24 that may have a channel 26 extending from a first peripheral edge 27 toward a second peripheral edge 28 of base 20. In this embodiment, blade 30 may be inserted into channel 26 when slicing or chopping foodstuff positioned on base 20.

When slicing foodstuff, a user can flip base 20 to choose between placing foodstuff on first surface 22 or second surface 24 of base 20. In one embodiment of the invention, first and second surfaces 22, 24 are generally parallel to each other. In another embodiment, at least one of first and second surfaces 22, 24 may have a concave region to capture or direct fluid flowing from the foodstuff positioned on base 20. Base 20 may be manufactured from a variety of materials, including plastic polymers, glass or metal that resists cutting.

In one embodiment, blade 30 may have a shape or design generally resembling a knife. As particularly illustrated in the embodiment depicted in FIG. 1, blade 30 preferably includes a first end 32 and a second end 34. Second end 34 may include a handle 36 disposed thereon for being grasped by a hand of a user operating blade 30 to slice the foodstuff. Blade 30 may also include a sharpened blade edge 38 for slicing the foodstuff positioned on base 20. Blade 30 is preferably manufactured from stainless steel, however, other materials may also be used.

As particularly illustrated in FIGS. 4-9, blade 30 preferably includes a pair of bosses 39 extending from blade 30. The pair of bosses 39 is preferably diametrically opposed to each other on blade 30. The pair of bosses 39 are also preferably positioned generally adjacent to first end 32 of blade 30 and are slidably and adjustably couplable to blade holding rack 40, wherein blade 30 pivots with respect to blade holding rack 40 and is abuttable against base 20. In a related embodiment, blade 30 can include one boss that engages rack 40.

In one example embodiment, rack 40 may be pivotally coupled to base 20 for positioning rack 40 between an upright operation position and a horizontal storage position. In the upright operation position, a longitudinal axis of rack 40 is generally perpendicular to base 20. In the horizontal storage position, a longitudinal axis of rack 40 lies generally in a plane parallel to a plane of base 20. Blade 30 is pivotally coupled to rack 40 in the upright operation position and is preferably removed from rack 40 when rack 40 is in the horizontal storage position.

Figure 2:
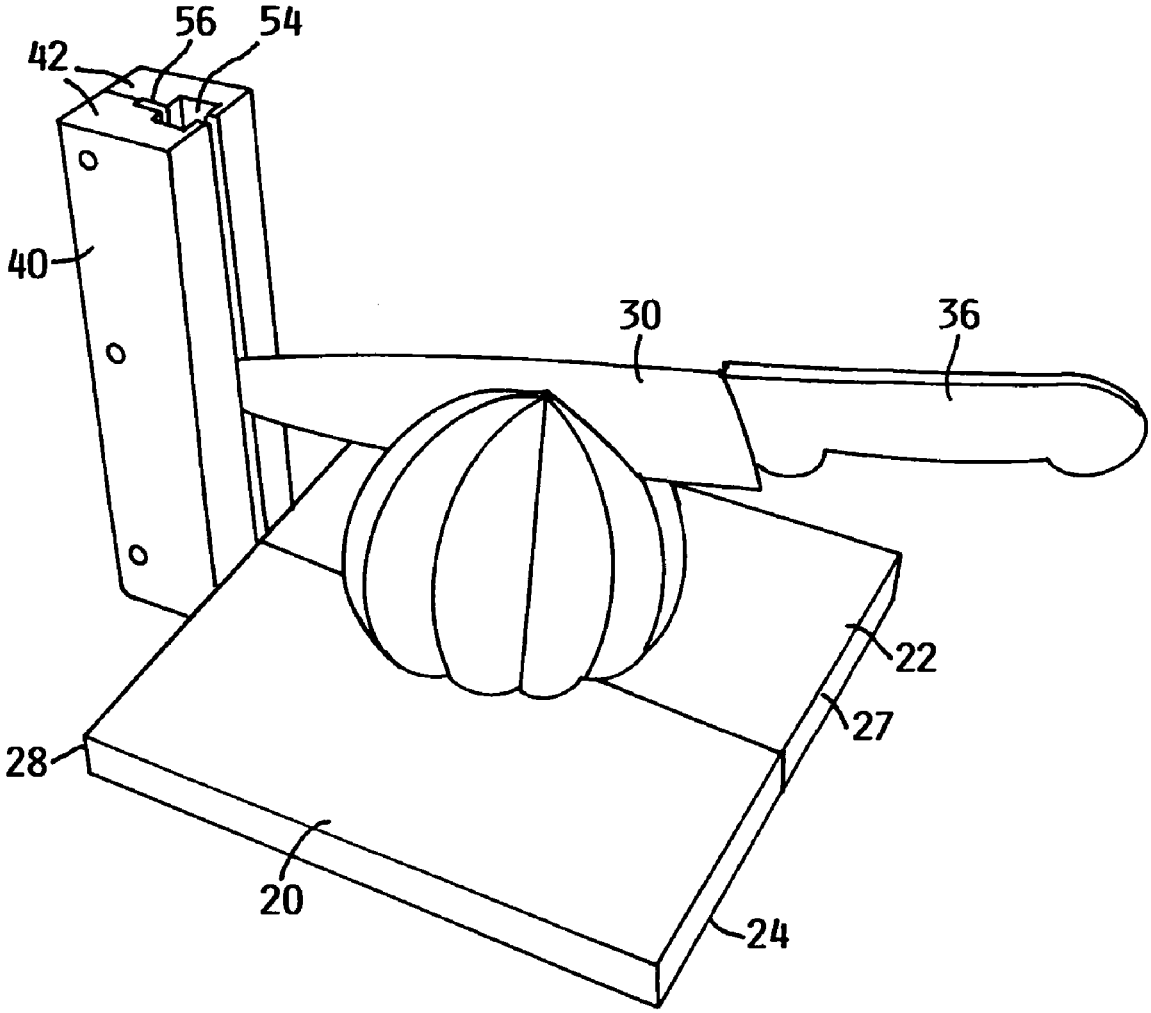
FIG. 2 is a side view of the adjustable slicing device.
Figure 3:
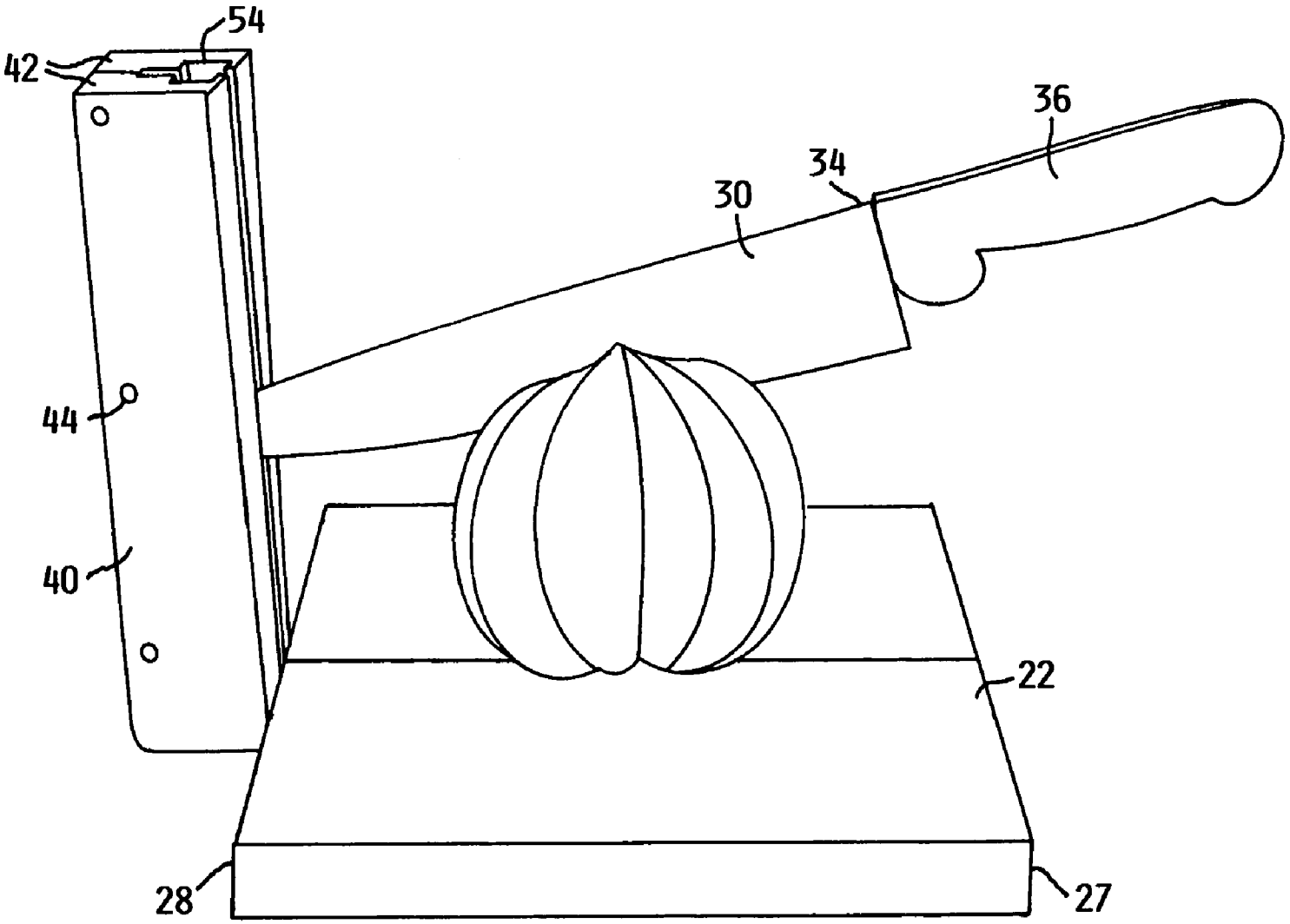
FIG. 3 is a side view of the adjustable slicing device in a partially assembled configuration.
Figure 4:
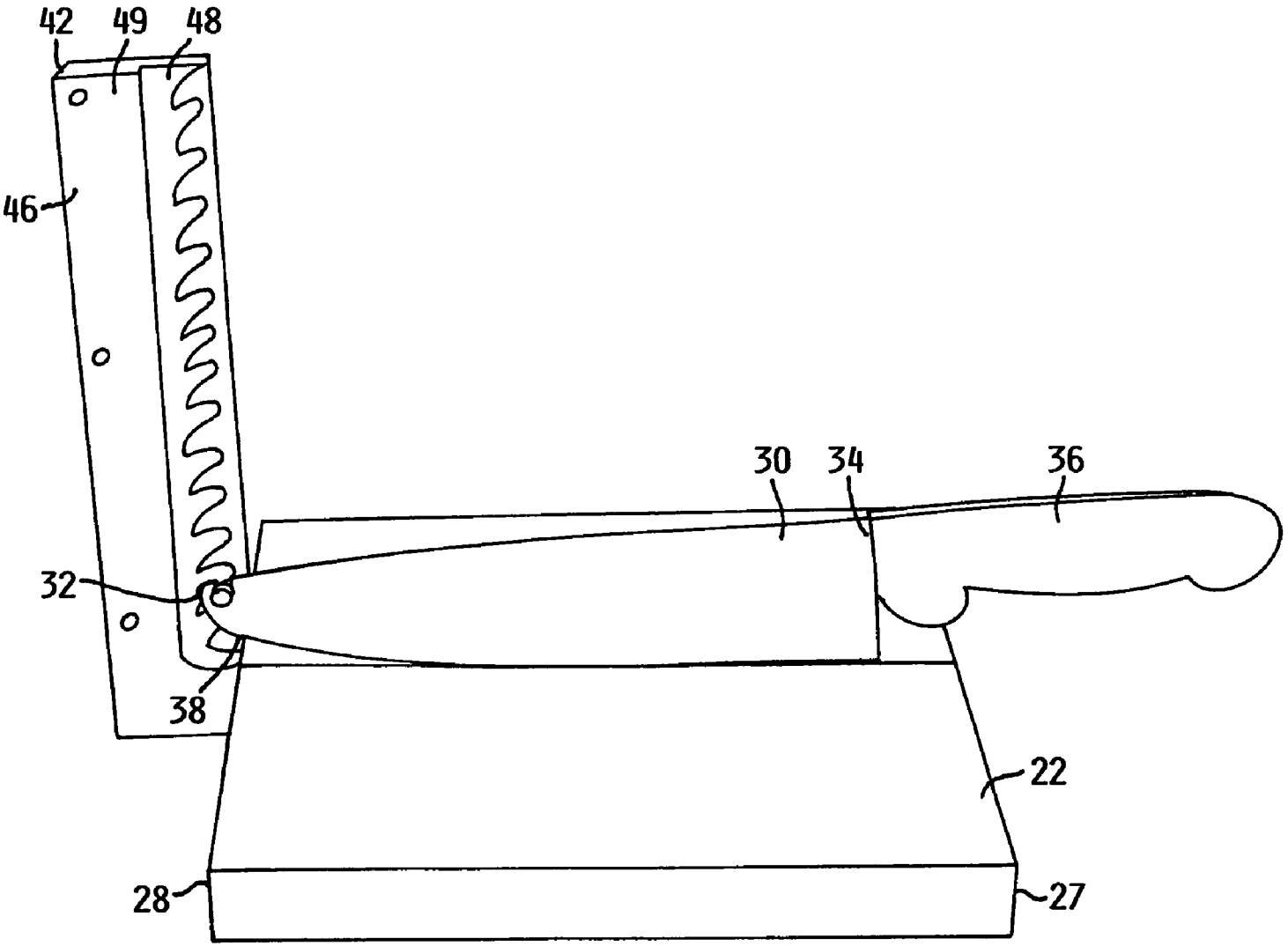
FIG. 4 is a perspective view of the adjustable slicing device in a partially assembled configuration.
Figure 5:
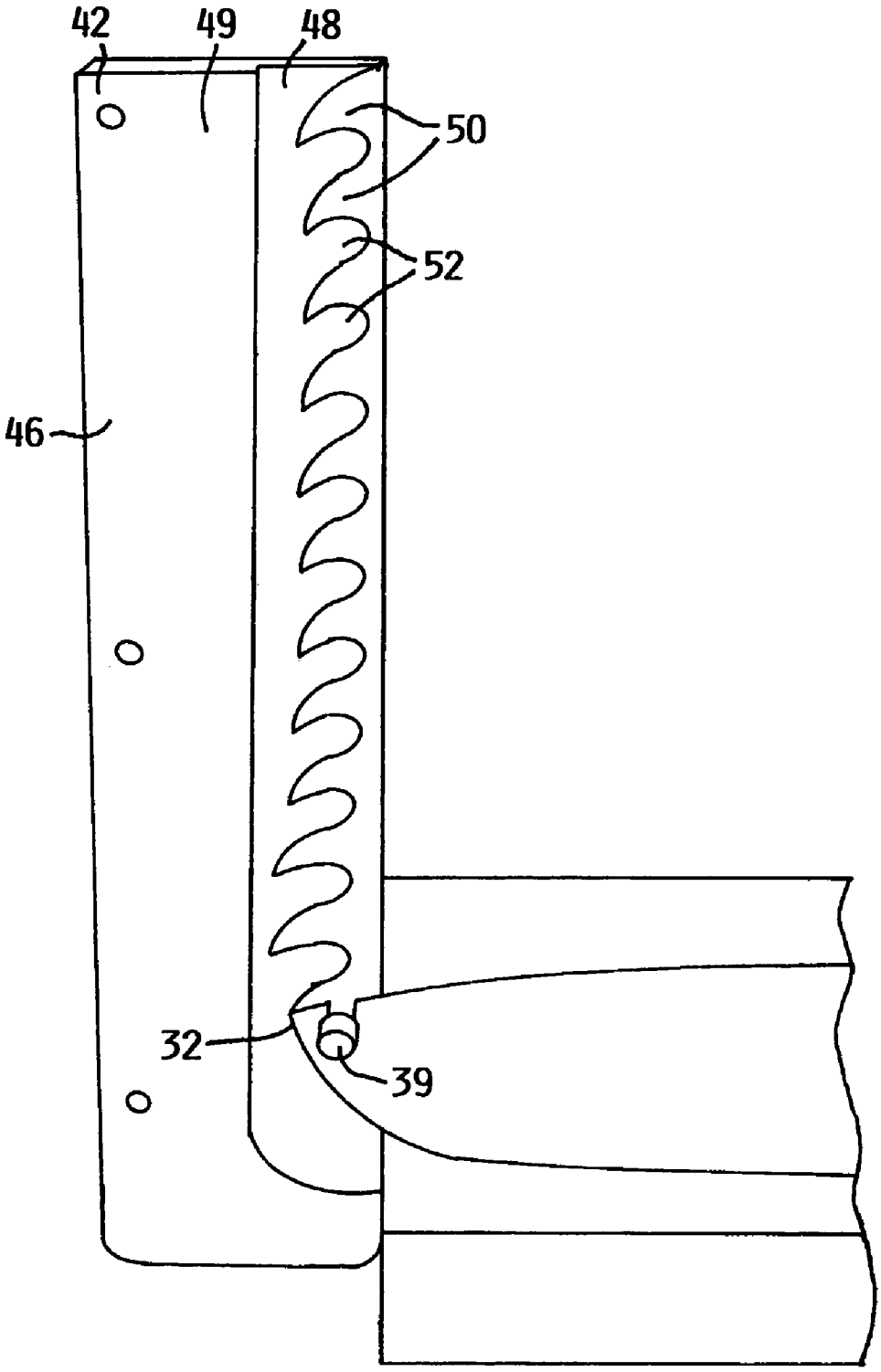
FIG. 5 is a perspective rear view of a fastener mounted to the rack.
Figure 6:
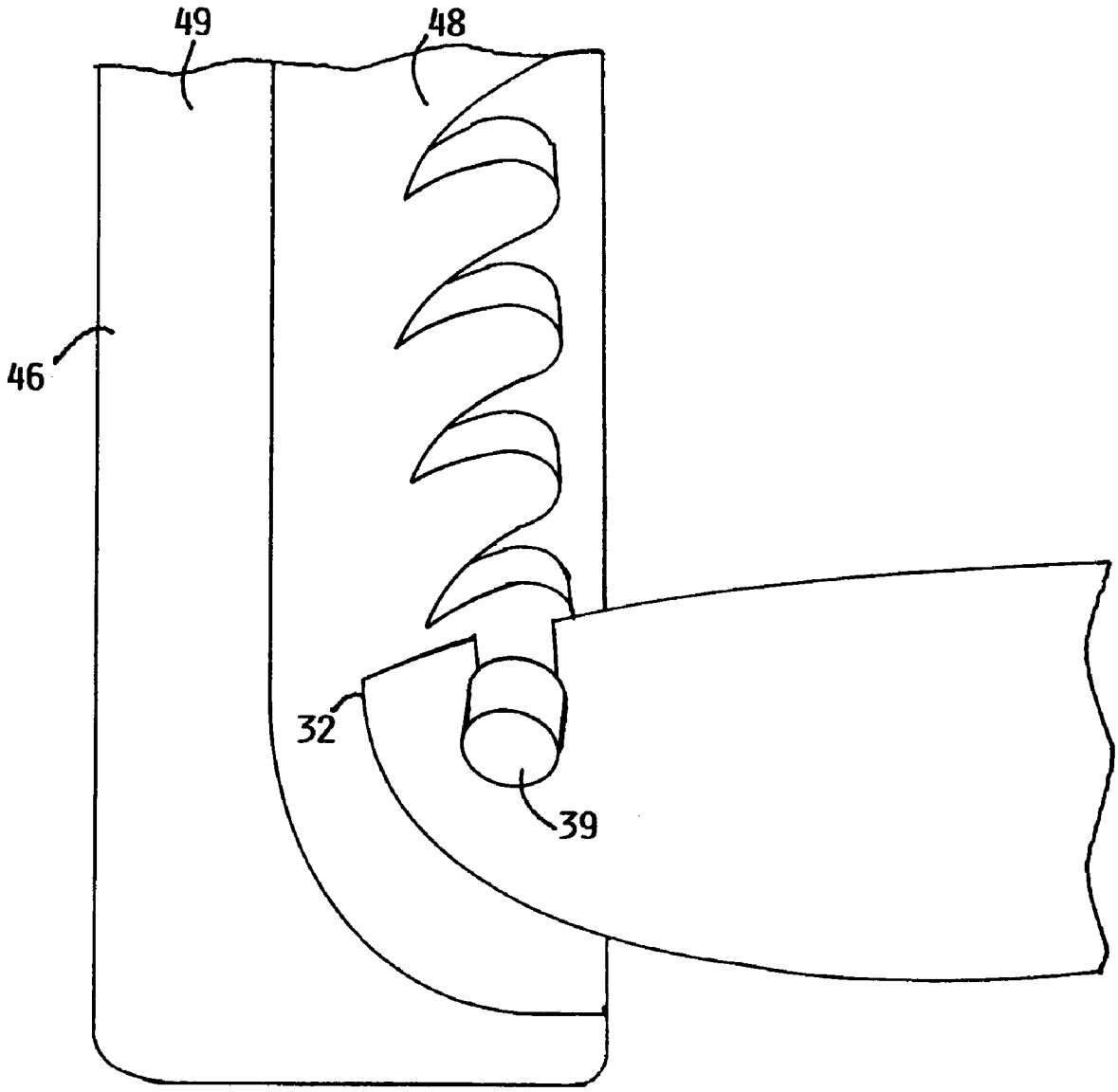
FIG. 6 is a top view of the base and the rack elements disposed in a first storage position.
Figure 7:
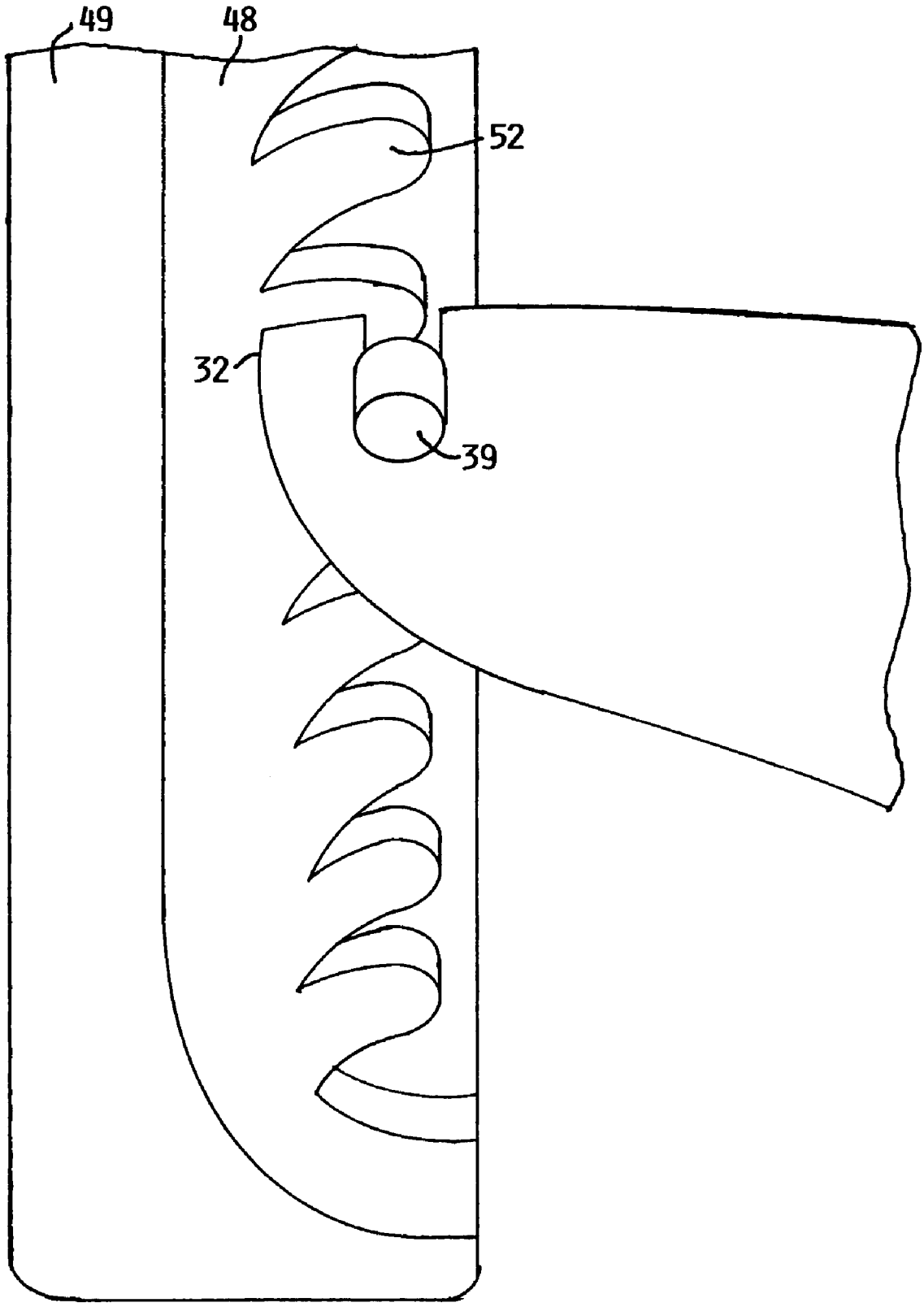
FIG. 7 is a bottom view showing latching members attached to the rack elements.
Figure 8:
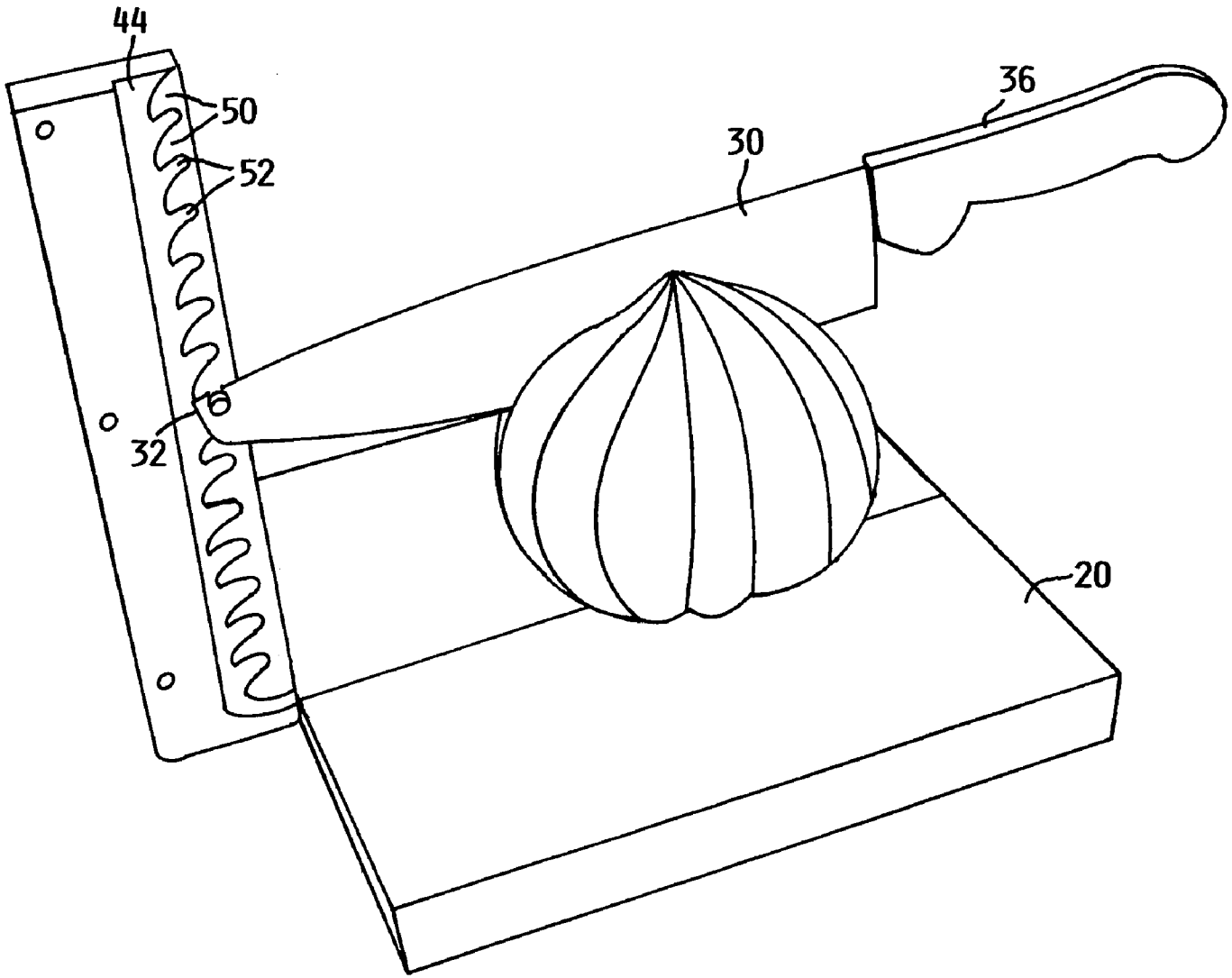
FIG. 8 is a bottom view of the base showing the rack elements in a second storage position.
Figure 9:
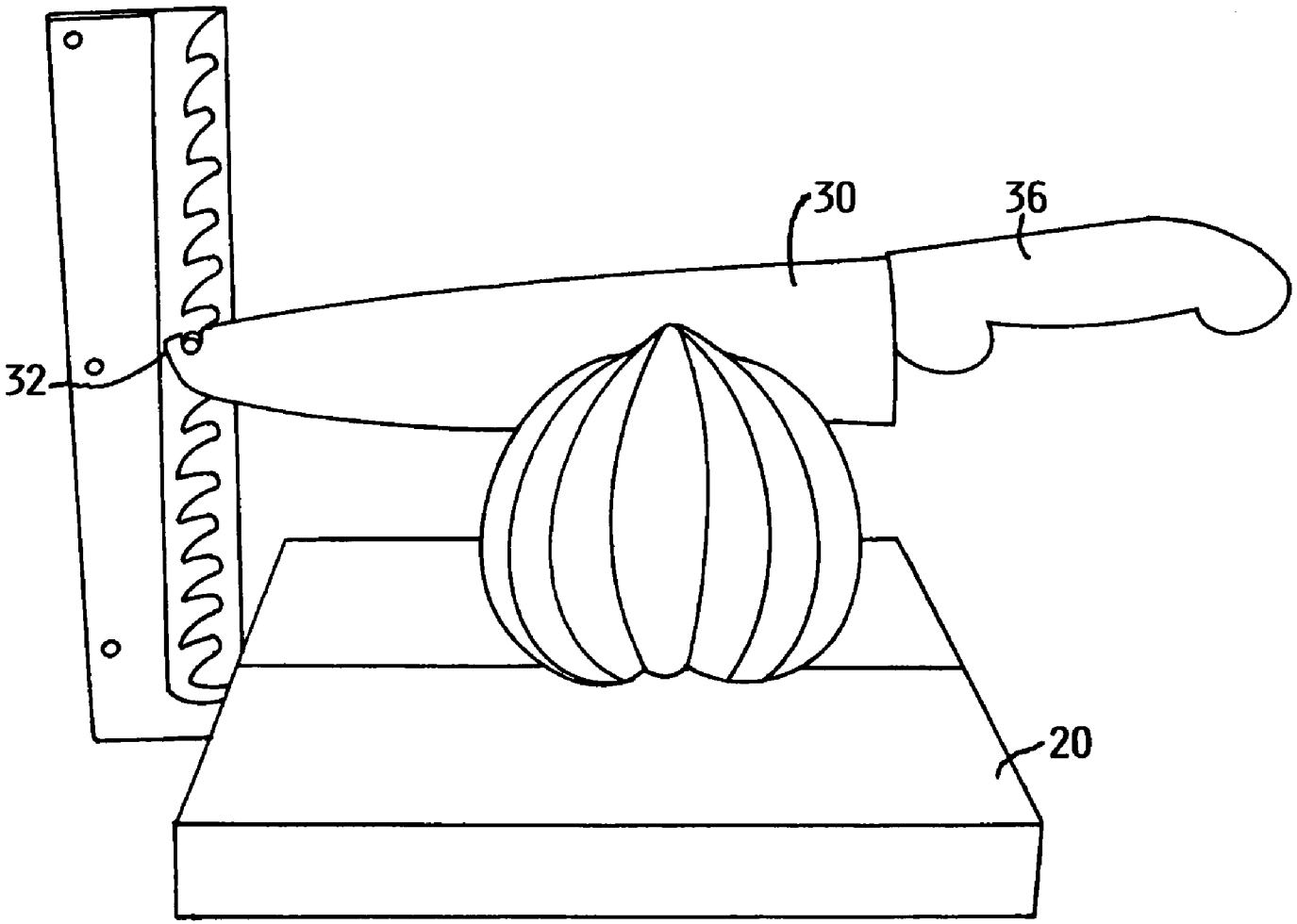
FIG. 9 is a perspective view of a stop that is insertable into the channel for restricting movement of the blade disposed in the rack.

Referring to FIGS. 2 and 3, blade holding rack 40 may include a pair of substantially similar rack elements 42 that are preferably detachably coupled together. In this particular embodiment, blade 30 is preferably slidably disposed or sandwiched between the pair of rack elements 42 when they are coupled together. Rack elements 42 may be detachably coupled together by a plurality of fasteners 44 extending through one rack element 42 and secured into the other rack element 42. Fasteners 44 may include screws or bolts. However, various fasteners may be used to detachably couple rack elements 42 together.

Referring back to FIG. 4, each of rack elements 42 preferably includes an inner surface 46 that has a first recess 48 and a second recess 49 extending along a length of rack elements 42. In one embodiment, as particularly illustrated in FIGS. 4-7, first recess 48 may be disposed generally adjacent to base 20 when rack 40 is coupled to base 20. Second recess 49 may be positioned generally adjacent to first recess 48.

The surface of first recess 48 preferably includes a plurality of alternating spaced teeth 50 and notches 52 formed thereon and extending generally a length of rack element 42. Spaced notches 52 have a shape and size adapted for receiving one of the bosses 39. In one example embodiment, each of the alternating spaced teeth 50 may have a generally arcuate shape for restricting outward movement of the pair of bosses 39 when positioned in one of spaced notches 52.

Referring back to FIG. 2, when rack elements 42 are coupled together first recess 48 of rack elements 42 form a channel 54 extending generally along a length of rack elements 42. Channel 54 provides access to each of spaced notches 52 such that the pair of bosses 39 travels vertically in channel 54 to a particular notch 52. Second recess 49 of rack elements 42 form a slot 56 extending into rack 40 that receives first end 32 of blade 30 and facilitates blade 30 travel in channel 54 of rack 40. In one embodiment, channel 54 has a generally wider cross-section than slot 56.

In another embodiment, a plurality of blades may be used to make multiple cuts of foodstuff positioned on base 20. In this embodiment, the handle may be coupled to the second end of each of the blades and a first end of each of the blades may be coupled together and adjustably disposed in the rack. In this embodiment, a surface of the base may include a multiple of grooves or slots extending therein for receiving each of the blades. The blades of this particular embodiment are removable from the rack to permit cleaning.

Figure 10:
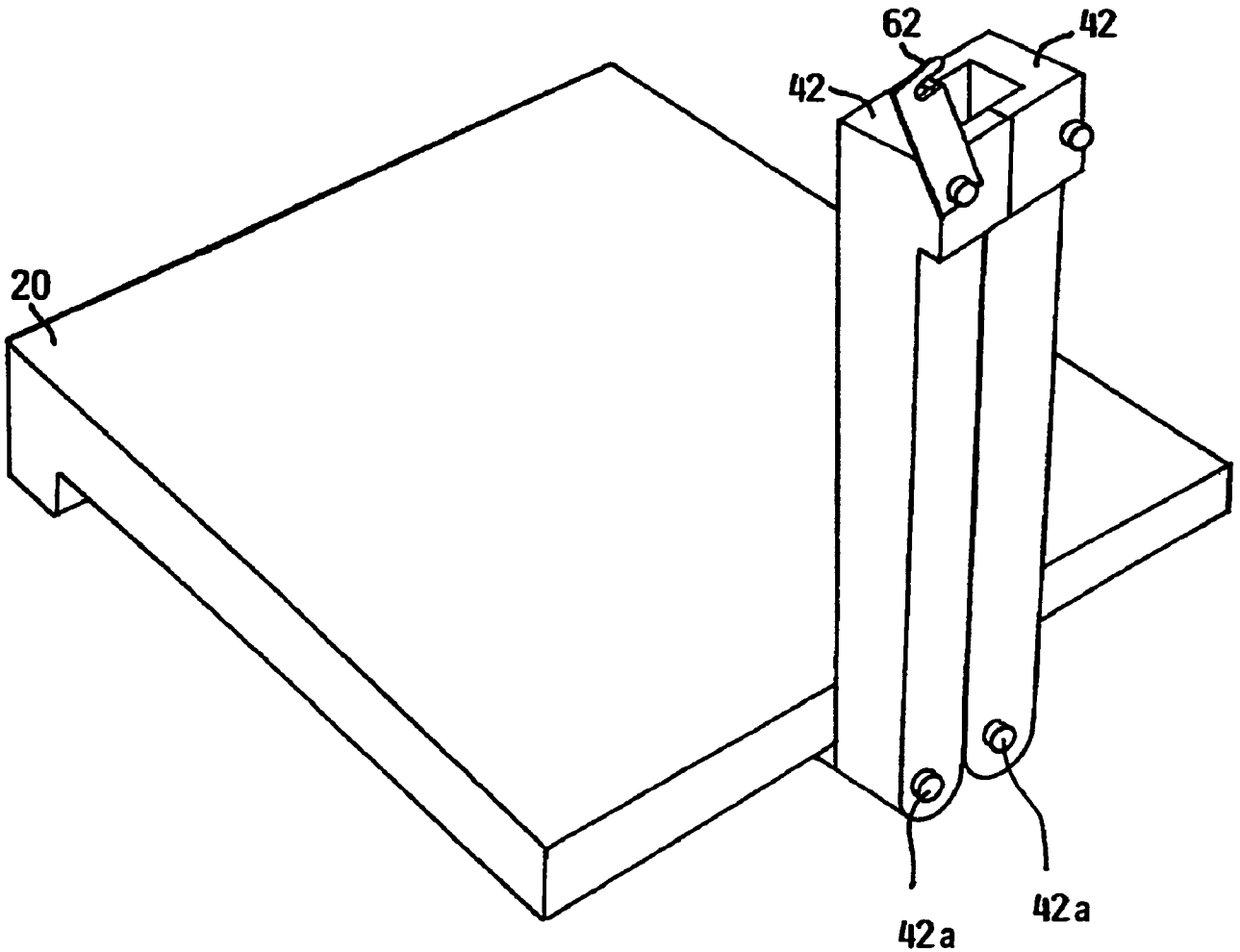
FIG. 10 is a perspective view of the blade and stop disposed in the rack.
Figure 11:
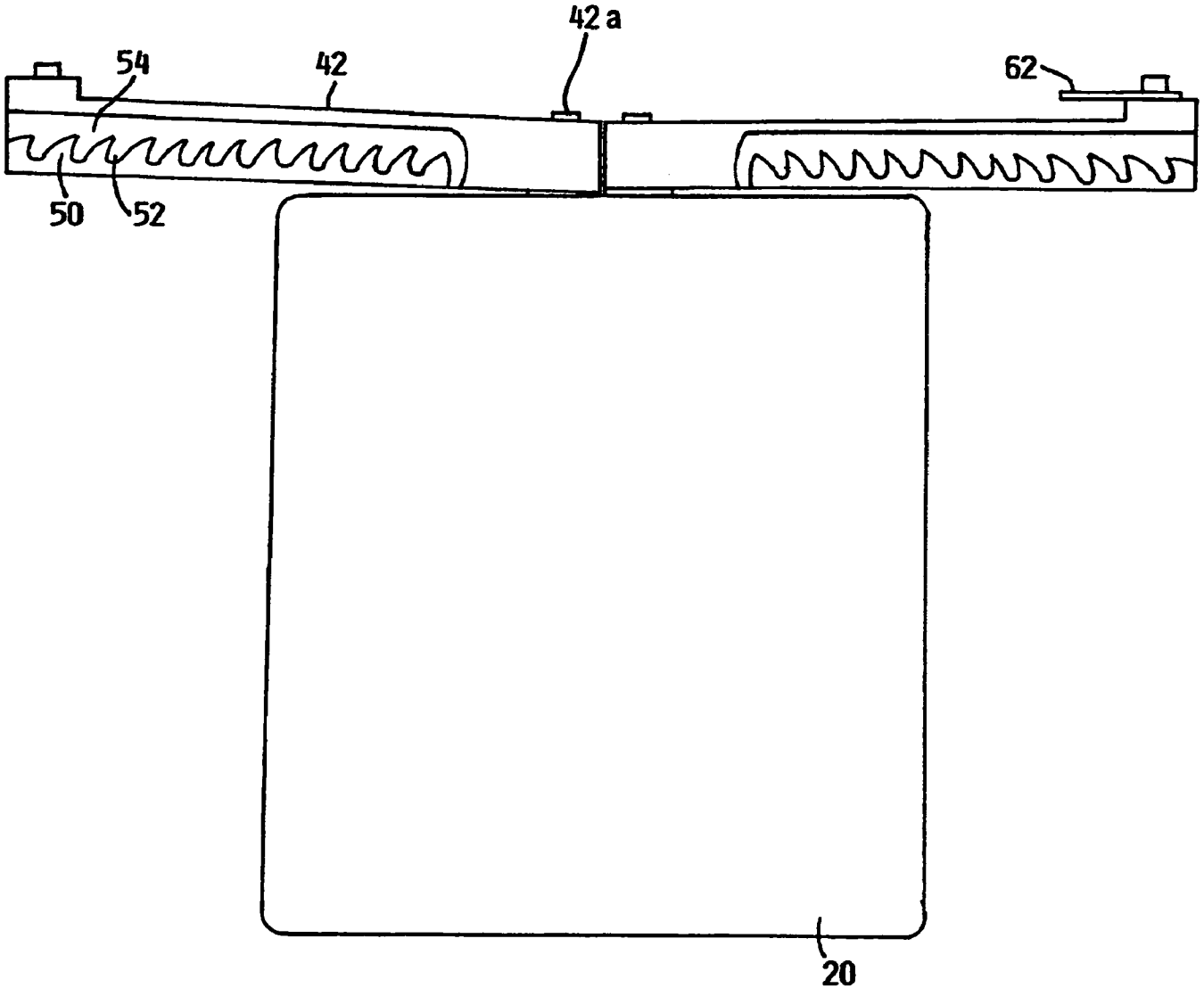
FIG. 11 is a top view of the rack of FIG. 10 with rack elements pivoted in an unlatched disposition.
Figure 12:
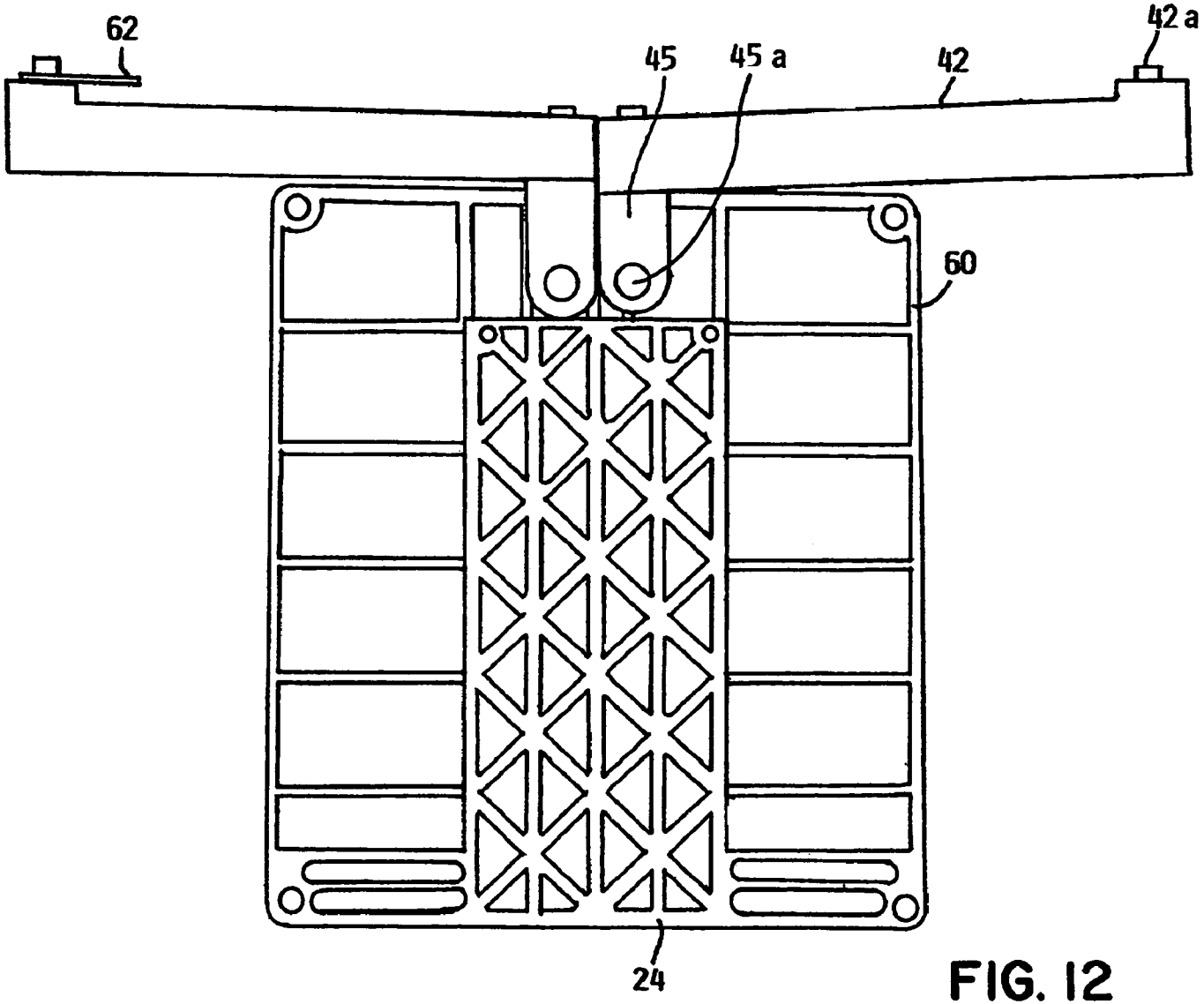
FIG. 12 is a bottom view of the rack of FIG. 10 with the rack elements pivoted in an unlatched disposition.
Figure 13:
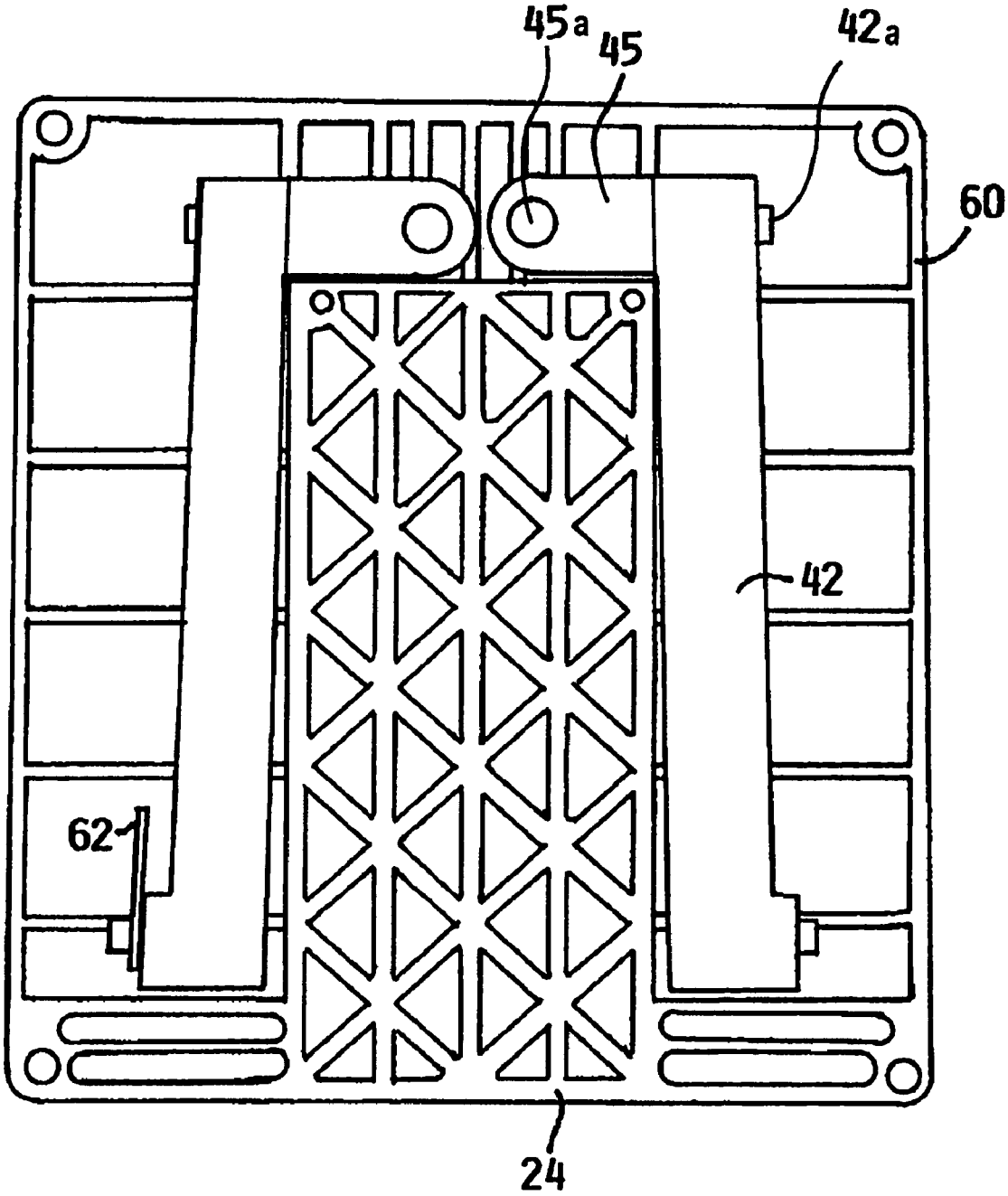
FIG. 13 is a bottom view of the rack of FIG. 10 with the rack elements pivoted under the base.

In another embodiment, as illustrated in FIGS. 10-15, rack 40 may be pivotally storable under base 20. Referring particularly to FIGS. 12-13 rack halves or elements 42 each include an arm 45 pivotally coupled to lower surface 24 of base 20 with an arm pin 45*a*. Each of arms 45 is pivotally coupled to an end of rack elements 42 with a rack pin 42*a* such that rack elements 42 are pivotally positionable around rack pin 42*a* as illustrated in FIG. 12 and arms 45 are pivotally positionable about arm pin 45*a* for positioning under base 20 as particularly illustrated in FIG. 13. In this embodiment of the invention, lower surface 24 of base 20 may include a recessed region 60 for receiving each of rack element 42 and arms 45 when pivotally disposed under base 20.

Referring to FIGS. 10 and 11, a latch 62 may be pivotally disposed on rack 40 to releasably secure rack elements or halves 42 together. In one embodiment, latch 62 may be positioned generally adjacent to an end of rack elements 42 opposite base 20. Latch 62 may comprise a hook latch or slide latch. Other latches and securing means are also envisioned within the spirit and scope of the invention.

Figure 14:
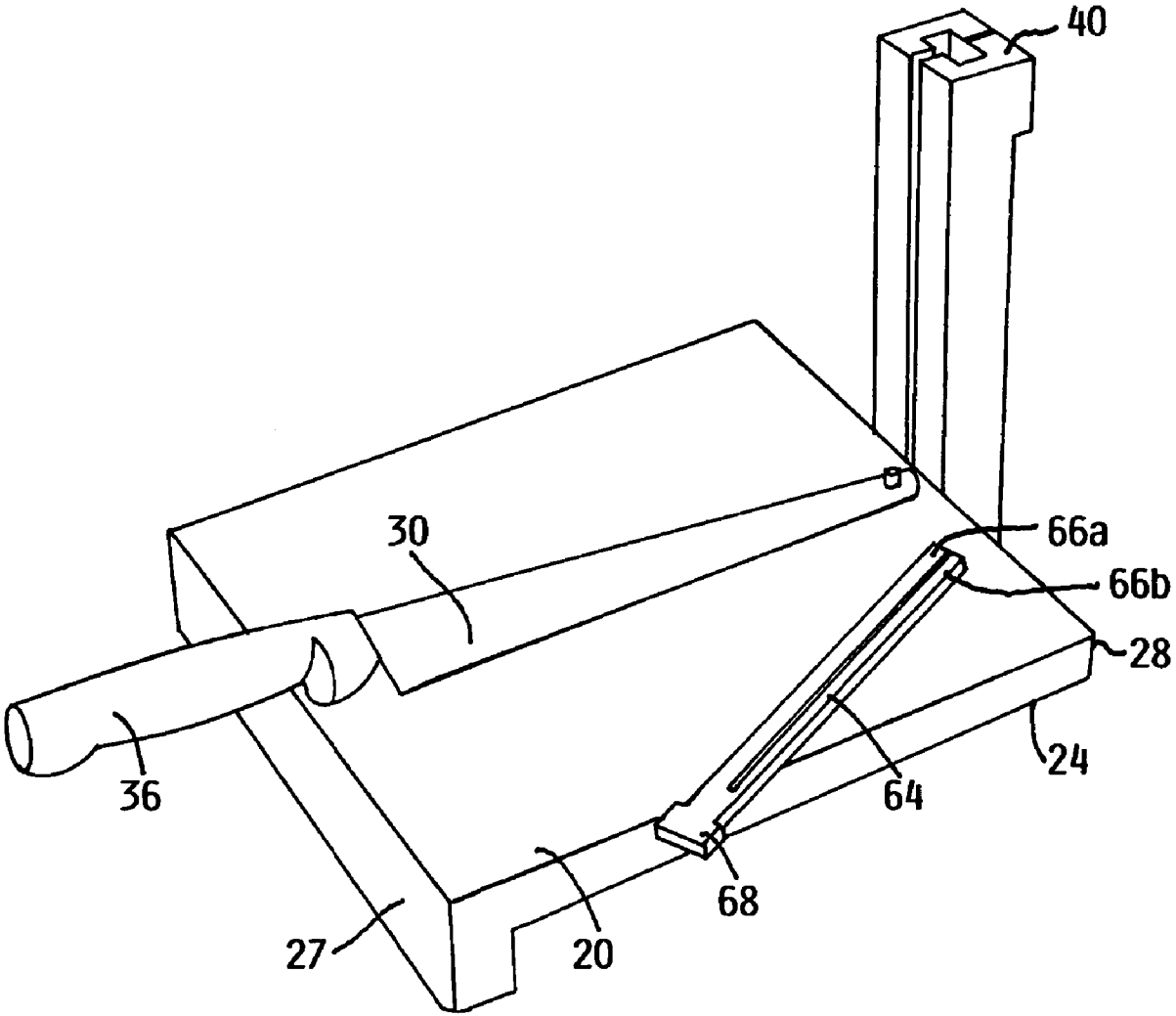
FIG. 14 is a perspective view of the rack of FIG. 10 prior to attachment of a blade.
Figure 15:
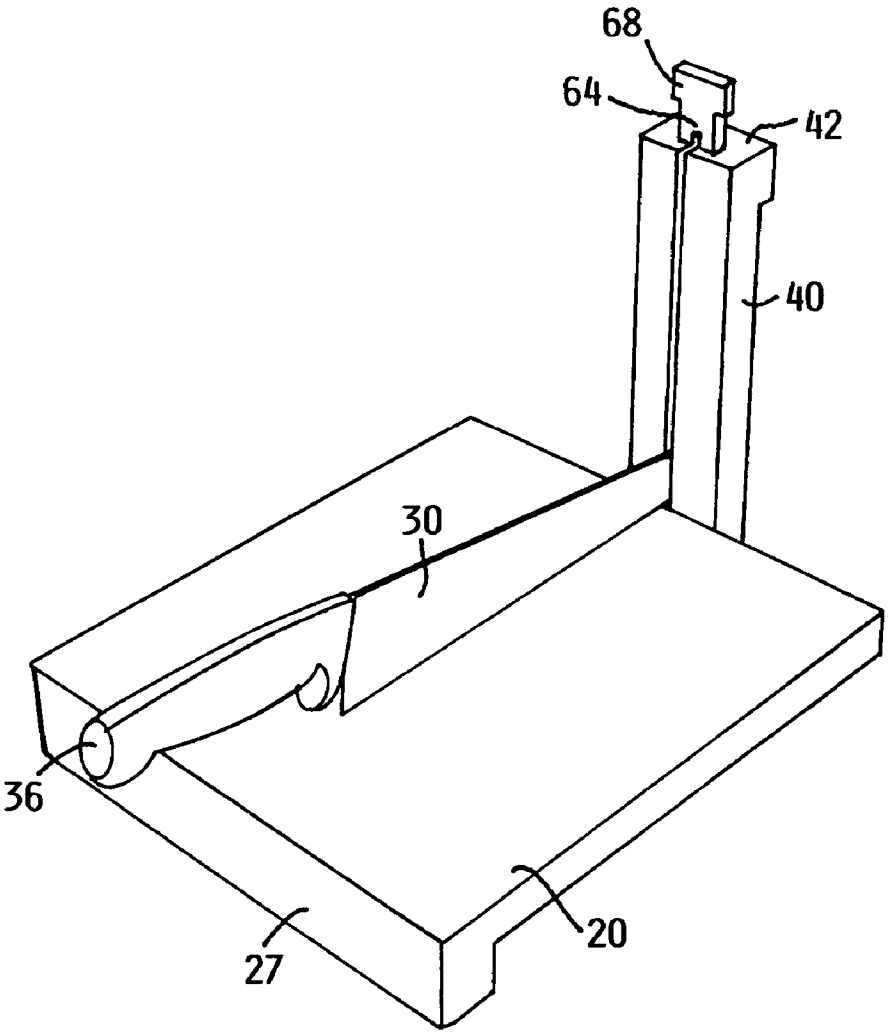
FIG. 15 is a perspective view of the rack of FIG. 10 including the blade retained by a stop member.

Referring to FIGS. 14 and 15, a stop member 64 may be removably inserted into channel 54 to restrict lateral movement of blade 30 in rack 40. Stop member 64 may comprise a pair of tines 66*a* and 66*b* disposed generally parallel to each other. Tines 66*a* and 66*b* are preferably spaced a distance apart to permit first end 32 of blade to move between them when being used to chop or slice the foodstuff. A handle 68 is coupled to and extends between an end of each tine 66*a* and 66*b* for gripping by a hand of a user inserting and removing stop member 64 from channel 54. Stop member 64 may comprise a plastic or metal material, however, other materials are envisioned within the spirit and scope of the invention.

In operation, pair of bosses 39 is inserted into channel 54 such that blade 30 extends over base 20. The foodstuff to be sliced is positioned on base 20 and positioned generally underneath blade 30. A user draws blade 30 toward themselves until the pair of bosses 39 enter one set of notches 52. Once the pair of bosses 39 is positioned in one set of the notches 52, a user grasping handle 36 may pivot blade 30 downwardly toward the foodstuff causing the blade to pivot toward base 20 and slicing through the foodstuff.

Blade 30 is preferably positionable in rack 40 such that blade edge 38, resting on the foodstuff, is oriented generally parallel to base 20. Positioning blade 30 parallel to base 20 before slicing the foodstuff ensures that the force exerted on blade 30 fixes foodstuff on base 20 while it is being sliced. Fixing foodstuff on base 20 with force from blade 30 prevents foodstuff from moving and permits a user to slice foodstuff without having to grasp or hold the foodstuff.

When large foodstuff is being sliced, a user may make the initial slice as described above and may then lower blade 30 with respect to rack 40 to make another slice. To lower blade 30 a user pushes blade 30 away from themselves until pair of bosses 39 enters channel 54 and first end 32 of blade 30 enters slot 56. First end 32 of blade 30 may then slide downwardly in channel 54 and slot 56 and then blade 30 may be pulled toward the user causing pair of bosses 39 to enter another, yet lower notch 52. Blade 30 is now oriented generally at an angle of base 20 and foodstuff position thereon. A user may then push on handle 36 slicing the foodstuff. A user may repeat these steps as many times as is necessary to cut or slice all the way through the foodstuff.

After blade is positioned in rack 40, a user may optionally insert stop member 64 to prevent bosses 39 of blade 30 from moving laterally within rack 40 and possibly becoming dislodged from spaced notches 52 when slicing a particularly large or hard foodstuff. As a user inserts stop member 64 into channel 54 each of tines 66*a* and 66*b* slides past first end 32 of blade 30 and blocks an opening of each of the nearby spaced notches. If a user needs to change a cutting position, stop member 64 may be lifted in channel 54 and blade 30 moved laterally to dislodge bosses 39. Once in the new cutting position, stop member 64 may be lowered back into channel 54 and cutting resumed.

Slicing device 10 can be easily disassembled for cleaning. Blade 30 is removed by moving the pair of bosses 39 into channel 54 and lifting on blade 30 until the pair of bosses 39 exit channel 54. In another embodiment, latch 62 may be moved such that rack elements 42 detach from each other. Base 20 may be detached from rack 40 for cleaning or may be pivotally disposed as illustrated in FIG. 12. Spaced teeth 50 and spaced notches 52 may be cleaned of any foodstuff that may accumulate during slicing. After cleaning rack elements 42 and arms 45 may be pivotally disposed under base 20 for storage.

The invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

The invention claimed is:

1. An adjustable food slicing device comprising:

a blade having an anterior end and a posterior end, wherein the blade has a cutting edge extending at least partially between the anterior end and the posterior end and a boss protruding from the blade;

a base having a first surface for receiving an article to be sliced opposite a second surface and first and second arms; wherein each of the first and second arms have a first proximal end portion and a second distal end portion defining a longitudinal axis therebetween, wherein each arm is mounted to the second surface at the first proximal end portion to permit rotation of the arms substantially perpendicular to the longitudinal axis; and a blade holding rack being positionable between an operation position arranged generally perpendicular to the base and a storage position arranged generally parallel to the base with the blade holding rack pivotally coupled to the base in both the operation position and the storage position, wherein the blade holding rack includes first and second rack elements defining a channel extending at least partially therethrough when in the operation position, the channel including a region formed with a plurality of notches spaced one from the other, the channel being configured to accept the boss for selective, releasable engagement with one of the plurality of notches to allow pivoting movement of the blade and wherein the first and second rack elements are pivotably secured at the second distal end portions of respective first and second arms for pivoting movement about the longitudinal axis from the operation position to an intermediate position whereupon a rotation movement of the arms causes the rack elements to be disposed in the storage position adjacent the second surface removed from the first surface.

2. The adjustable food slicing device of claim 1, wherein the channel extends longitudinally in the blade holding rack and is configured to accommodate at least a portion of the boss for movement therein, and wherein the boss is shaped and dimensioned to be selectively positioned adjacent to and urged into releasable engagement with one of the plurality of notches.

3. The adjustable food slicing device of claim 1, wherein the channel has opposed edge portions defining an opening oriented towards the base, and wherein the channel is configured to accommodate the boss and a first region of the blade proximate the boss for sliding movement in the channel with a second region of the blade including at least a portion of the blade edge protruding from the opening to extend over the base.

4. The adjustable food slicing device of claim 3, wherein each edge portion comprises a surface contoured to form the plurality of successive notches, wherein the respective contoured surfaces of opposing edge portions are positioned with each notch of the first edge portion oriented opposite a corresponding notch of the second opposed edge portion, and wherein each opposed pair of notches is adapted to releasably engage the boss to allow pivoting movement of the blade toward or away from the base.

5. The adjustable food slicing device of claim 1, wherein the blade comprises a planar surface with opposed first and second sides coterminous with the blade edge with the boss operably attached to the surface, wherein the boss has a first portion disposed at a first location on the first side generally opposite a second portion disposed on the second side, and wherein the first and second portions extend in opposite directions outward the first and second sides respectively.

6. The adjustable food slicing device of claim 1, wherein the base is configured with at least a first planar surface for supporting the article to be sliced and the channel is disposed substantially perpendicular to the at least first planar surface.

7. The adjustable food slicing device of claim 1, wherein each rack element has a surface including a first recess adjacent a second recess, wherein the first and second recesses extend generally longitudinally of the rack element, wherein the second recess has a contoured surface formed with an alternating saw-tooth, notch combination, wherein the first and second rack elements are operably coupled to place the surfaces of opposing rack elements in aligned engagement with the first recesses of opposed rack elements cooperating to define the channel when arranged in the operation position and each notch of the first rack element disposed opposite a corresponding notch of the opposed second rack element, and wherein each opposed pair of notches is adapted to releasably engage the boss for pivoting movement of the blade.

8. The adjustable food slicing device of claim 1, wherein the blade holding rack is detachable from the base.

9. The adjustable food slicing device of claim 1, further comprising a stop member having first and second longitudinal tines depending from first and second ends of a cross member and substantially parallel to each other, and wherein the stop member is inserted into the channel with first and second tines adjacent first and second sides of the blade surface to prevent the boss from exiting out of engagement with the notches and to restrain movement of the blade transverse to the channel.

10. An adjustable food slicing device comprising:

an elongated base having a first surface for receiving an article to be sliced and a second surface generally opposite the first surface and first and second arms; wherein each of the first and second arms have a first proximal end portion and a second distal end portion defining a longitudinal axis therebetween, wherein each arm is mounted to the second surface at the first proximal end portion to permit rotation of the arms substantially perpendicular to the longitudinal axis;

a blade having an anterior end and a posterior end, wherein the blade has a blade surface with opposed first and second sides, at least one blade edge for slicing through said article, and a boss, wherein the at least one blade edge extends at least partially between the anterior end and posterior end and coterminous with the first and second sides, and wherein the boss is located proximate the anterior end and extending substantially transverse to the blade edge; and a blade holding rack having a pair of opposing rack elements pivotably attached at the second distal end portions of respective first and second arms for pivoting movement about the longitudinal axis from an operation position to an intermediate position whereupon a rotation movement of the arms causes the rack elements to be disposed in a storage position adjacent the second surface removed from the first surface wherein the operation position includes the rack elements operably coupled to cooperatively define a channel with an opening between opposing edge portions, wherein the channel extends generally longitudinally of the rack and is adapted to slidingly accommodate a first region of the blade including the boss for rectilinear movement therein with a second region of the blade protruding from the opening to extend over the base, wherein the opposing edge portions are formed with a plurality of successive notches disposed at a plurality of heights relative to the base, and wherein the boss is adapted to selectively and releasably engage in one of said notches thereby to lock the blade for pivoting movement of the blade edge toward or away from the base to cause the slicing of the article disposed on the base in a path of the blade edge.

11. The adjustable food slicing device of claim 10, wherein each rack element has a surface including a recess extending generally longitudinally of the rack element flanked by an edge portion provided with an alternating saw-tooth, notch formation, and wherein the respective surfaces of opposing rack elements are placed in aligned engagement to cooperatively define the channel.

12. The adjustable food slicing device of claim 10, wherein the blade holding rack includes a latch for releasably securing the rack elements so as to define the channel.

* * * * *